United States Patent [19]

Olivieri

[11] 4,037,333

[45] July 26, 1977

[54] LACING DEVICE FOR SKI BOOTS

[76] Inventor: Icaro Olivieri, 10, Via Feltrina Nord, Montebelluna, Italy, 31044

[21] Appl. No.: 717,289

[22] Filed: Aug. 24, 1976

[30] Foreign Application Priority Data

Sept. 18, 1975 Italy ..... 12795/75

[51] Int. Cl.[2] ..... A43B 5/04; A43B 11/00; A43C 11/00

[52] U.S. Cl. ..... 36/117; 36/50; 24/70 SK

[58] Field of Search ..... 36/117, 118, 119, 120, 36/121, 50; 24/68 SK, 70 SK

[56] References Cited

U.S. PATENT DOCUMENTS

| | | | |
|---|---|---|---|
| 3,654,670 | 4/1972 | Baso | 36/117 |
| 3,956,796 | 5/1976 | Guolo | 36/50 |
| 3,967,391 | 7/1976 | Kastinger | 36/50 |

*Primary Examiner*—Patrick D. Lawson

*Attorney, Agent, or Firm*—Marvin Feldman; Stephen E. Feldman

[57] ABSTRACT

The lacing device for ski boots comprises a hooked lever-like lacing member which cooperates with a flexible elastic ring-like lacing member. In order to secure the ring-like lacing member to the flap of the ski boot upper, on the flap there is provided a projection which is substantially shaped, in plan view, as a "filled U" and presents a side groove along the "U" outline. A locking element is provided, which consists of a U-shaped plate formed so as to define a correspondingly U-shaped channel, inside which there is housed a portion of the ring-like lacing member, prior to the engagement of the U-shaped plate into the groove provided on the projection. Thus, upon engagement of the locking element plate inside the groove of the projection, a portion of the ring-like lacing member results to be encased in the tubular channel defined by the groove and by the locking element. Anchoring means are provided in order to avoid accidental disengagement of the locking member from the groove.

8 Claims, 7 Drawing Figures

LACING DEVICE FOR SKI BOOTS

BACKGROUND AND SUMMARY OF THE INVENTION

The present invention relates to a lacing device for ski boots, and more particularly to novel means for anchoring one of the two members composing the said lacing device to the ski boot.

The modern ski boots are provided with a number of lacing devices each comprising a hooked lever-like lacing member cooperating with a ring-like lacing member. The said members are usually fastened to base plates, which in turn are secured, usually by means of rivets, to the ski boot upper, at both sides of the longitudinal opening formed in the upper and defined by the two flaps of the ski boot upper.

According to the two co-pending applications No. 699,682 and No. 699,700, both filed on June 25, 1976 in the name of the same applicant as in the present invention, means have been proposed for easily mounting and disassembling the lacing members on the ski boot upper, by providing on the said upper suitably shaped projections onto which there may be secured, with a snap fit or with a sliding fit, elements for hingedly supporting and anchoring to said projections the lacing members.

The object of the present invention is to provide novel means for anchoring to the ski boot upper the ring-like lacing member of the lacing device, and particularly a ring-like lacing member of the type constructed with flexible elastic wire.

Lacing members constructed of a closed (ring-like) piece of elastic flexible wire, preferably steel wire, are well known in the art, and are advantageously employed since, due to their flexibility, they can be directly secured to the ski boot upper without the need of elements ensuring a hinged connection to the said upper, as instead it is necessarily required in the case of ring-like lacing members constructed of rigid (not flexible) wire material, (see for example the two above mentioned applications). Usually, these ring-like lacing members of elastic flexible wire are secured to the ski boot upper by means of metal straps which are riveted to the upper, or by other means which anyhow require, both at the moment of assembling of the lacing device on the upper, and at the moment of disassembling same from the upper, the operation of a skilled person with the aid of special tools and, particularly in the case of substitution of damaged parts, with the additional risk of damaging the boot.

According to the present invention, the anchoring of the flexible elastic ring-like lacing member on the ski boot upper is accomplished by providing on the ski boot upper a suitably shaped projection presenting a groove which can be engaged by a locking element provided with at least a channel like portion inside which there can be arranged a portion of the flexible ring-like lacing member, in such a manner that, upon engagement of the locking element inside the groove of the projection, a portion of the ring-like lacing member is practically enclosed in at least a tubular channel defined by the locking element and by a wall of the groove, whereby the ring-like lacing member will have the possibility of axially sliding along said tubular channel, which is most advantageous for adjustment purposes, while being secured to the ski boot upper.

In order to avoid an accidental disengagement of the locking element from the projection provided in the ski boot upper, the said locking element is provided with suitable anchoring means, such as indentations or portions adapted to snap into correspondingly shaped portions of the ski boot upper.

These and other features of the invention will be clearly understood from the following description of some preferred embodiments thereof with reference to the accompanying drawings, and the novel features will be particularly pointed out in the appended claims.

DESCRIPTION OF THE PREFERRED EMBODIMENT

Figure 1:
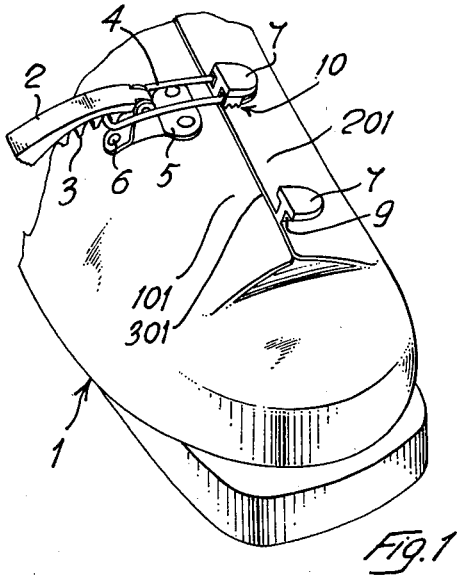
FIG. 1 is a perspective view of the broken away front portion of a ski boot provided with a lacing device according to the invention.

With reference to the drawings, and particularly to FIG. 1, reference numeral 1 indicates a ski boot made of plastic material. The ski boot upper is provided, in a conventional manner, with two flaps 101, 201, which define between them the longitudinal opening 301 (which, in the case of superposed flaps, as in the present case, constitutes the line of closure of the two flaps). To the said flaps there must be anchored, or anyhow secured, the lacing devices which are of the conventional type, comprising a lever-like lacing member 2 provided with hook indentations 3 on one flap (101), intended to cooperate with an elastic flexible ring-like lacing member 4 on the other flap (201). The lacing member 2 is hingedly mounted on flap 101 in a known manner, by means of a supporting plate 5 secured by rivets 6 to the said flap.

Figure 3:
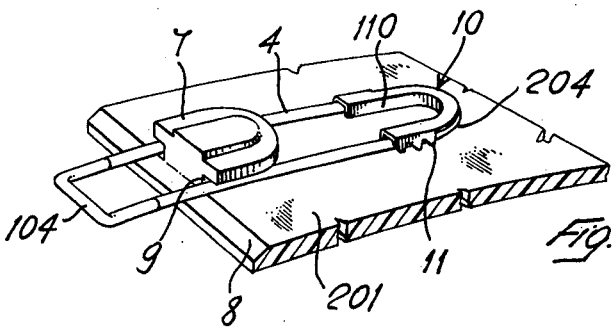
FIGS. 3 and 4 illustrate, in perspective view, two different steps of the assembling and anchoring of the ring-like lacing member onto the corresponding flap of the ski boot upper.

In correspondence of the edge 8 of the other flap 201 there are provided (see also FIGS. 3 and 4) the projections 7 presenting (viewed from the top) a substantially semicircular or "filled U" shape, and having an enlarged head portion so as to define a peripheral or side groove 9 which follows the outer "U" contour of the projection 7. The said projections 7 are preferably obtained of one piece with the flap 201, at the moment of molding of the ski boot upper.

Figure 2:
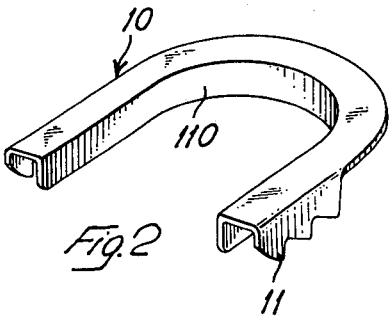
FIG. 2 is a perspective view showing, in enlarged scale, the locking element for the ring-like lacing member of the lacing device.

In FIG. 2 there is illustrated the locking element 10 for securing the ring-like lacing member 4 to the projection 7 on flap 201. Each locking element 10 consists of a substantially U-shaped metal plate having such dimensions as to exactly fit into the correspondingly shaped groove 9 of projection 7, and presenting an internal edge 110 bent at right angles with respect to the plate itself and having a height which preferably is slightly greater than the width of the groove 9 of projection 7. In correspondence of the sides of the said U-shaped metal plate 10 there are provided external wings 11 bent at square angles with respect to the plate itself, so as to result parallel to the respective sections of internal edge 110, thus defining channel-like portions in correspondence of the said sides of the metal plate locking element 10. The said wings 11 are provided with indentations the points of which extend up to a length which is greater than the width of the groove 9 of projection 7.

The securing of the ring-like lacing member 4 onto flap 201, by cooperation of the locking element 10 with the projection 7, takes place in the following manner:

The ring-like lacing member 4 (which usually is made of steel wire) is arranged so as to present its "front" portion 104 (i.e. the usually rigid shaped portion which is intended to cooperate with the other lacing member 2) directed beyond the edge 8 of flap 201. The "rear" flexible elastic portion 204 of the said ring-like lacing member 4 is partially inserted in the channel portions of the locking element 10 which is placed at some distance with respect to the projection 7, said projection being encircled by the ring-like lacing member 4 (see FIG. 3). The lacing member 4 is then pulled (see FIG. 4) by the rigid end 104 in a direction towards the exterior of edge 8 of flap 201. The rear portion 204 of said ring 4 engages the edge 110 of the locking element 10, which is thus caused to be inserted, with some friction, inside the correspondingly shaped groove 9 of projection 7, while the indentations provided on wing 11 of the locking element 10 penetrate with their points ("bite") into the plastic material surface of the flap 201 thus acting as anchoring members of the locking element. In this manner the locking element 10 is actually locked in correspondence of the projection 7, and the ring-like lacing member 4 is secured to the flap 201 in correspondence of said projection 7.

Figure 4:
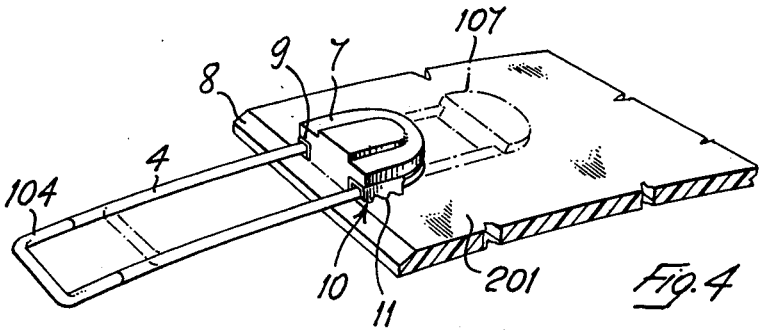

With reference to FIG. 4, and with particular attention to the dash-and-dot lines detail illustrated in said Figure, it can be noted that an adjustment of the distance of the lacing member 4 with respect to the cooperating lacing member 2 on the other flap can be obtained by simply providing a semicircular projection 107 presenting a semicircular groove which can be engaged by the rear portion 204 of the ring-like lacing member 4, while the securing of the ring to the flap 201 is obtained, as above explained, by the cooperation of the locking element 10 with the projection 7. In fact, it can be appreciated that, since the locking element 10 presents two parallel channel portions defined by the wings 11 and by the corresponding facing sections of the edge 110, the lacing member 4, although secured to the flap by the locking element 10 can slide axially through said channel portions rearwardly, i.e. in a direction away from the edge 8 of the flap, and it can be hooked by its rear portion 204 onto the semicircular projection 107. It will be appreciated that, in its simplest form, the projection 107 may present the shape of a button-like projection, and alternately it may be constructed as a toothed rack, each tooth of which serves as anchoring point for hooking the rear end of the lacing member 4.

MODIFICATIONS

Figure 5:
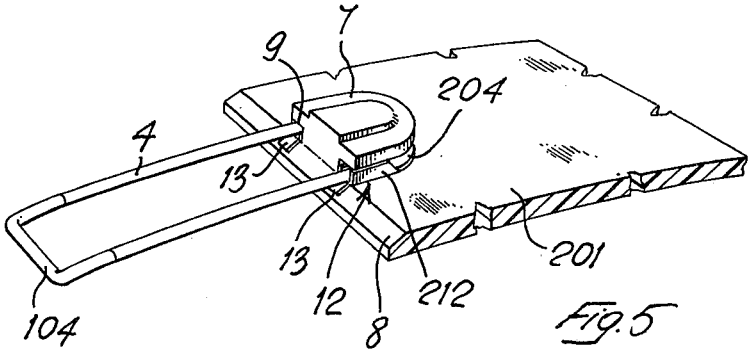
FIG. 5 shows in perspective view a modification of the locking element illustrated in FIG. 2, as assembled on the ski boot upper.
Figure 6:
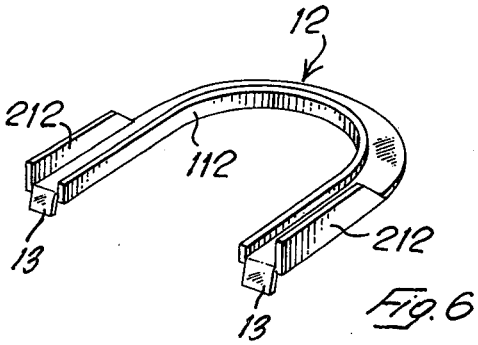
FIG. 6 is a perspective view of the locking element according to FIG. 5.

The locking element 12 illustrated in FIGS. 5 and 6 consists of a substantially U-shaped metal plate having such dimensions as to exactly fit into the corresponding shaped groove 9 of projection 7, and presenting an internal edge 112 bent at right angles with respect to the plate itself. The said U-shaped metal plate locking element 12 is further provided, in correspondence of its sides, with external wings 212 bent at right angles with respect to the said plate, so as to result parallel to the corresponding portions of the internal edge 112, thus defining channel-like portions. The U-shaped locking element 10 is provided, in correspondence of its free ends, with two down-turned lugs 13 (i.e. bent in a direction which is opposite to the direction of edge 112 and wings 212).

The method of securing of the lacing member 4 onto flap 201 appears evident from FIG. 5. By pulling the ring 4 towards the exterior out of flap 201, after having inserted its rear portion 204 in the channel portions of locking element 12, the said locking element is caused to be anchored tightly fitted inside groove 9 by the cooperation of the down-turned lugs 13 acting as anchoring members, with the oblique edge 8 of the said flap, which has been designed with a suitable inclination. If the nature of the materials employed will permit so, the lugs 13 may be bent down to right angles with respect to the plate 12, and consequently the edge 8 will be at right angles with respect to the surface of flap 201.

Figure 7:
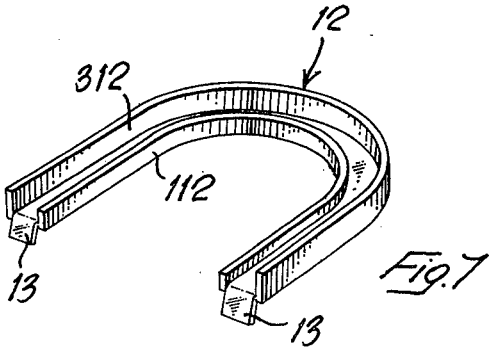
FIG. 7 shows a further modification of the locking element illustrated in FIGS. 5 and 6.

FIG. 7 shows a modification of the locking element 12, according to which the said locking element presents, besides the internal edge 112, also an external edge 312 which runs along the whole external profile of the U-shaped plate. The provision of this continuous external edge along the profile of the U-shaped locking element may be also adopted in the embodiment shown in FIGS. 1 to 4.

It is believed that the invention will have been clearly understood from the foregoing detailed description of some preferred embodiments. Changes in the details of construction may be resorted to without departing from the spirit of the invention, and it is accordingly intended that no limitation be implied and that the hereto annexed claims be given the broadest interpretation to which the employed language fairly admits.

I claim:

1. In a ski boot of the type comprising a ski boot upper provided with two flaps defining an opening, a lacing device including a hooked lever-like lacing member provided on one flap and intended to cooperate with a flexible elastic ring-like lacing member on the other flap, means for securing said flexible elastic ring-like lacing member in a removable manner onto its flap, said means comprising:

a. a shaped projection provided on the flap and presenting at least a side groove;

b. a locking element in the form of a small plate shaped so as to present at least a channel-like portion capable of slidably engaging the said groove provided on the shaped projection, so as to define, upon engagement with the said groove, a tubular channel for housing a portion of the said ring-like lacing member;

c. at least an anchoring member provided on said locking element, capable of engaging a portion of the flap in order to secure the locking element in the position in which its channel-like portion engages the groove provided on the shaped projection.

2. A lacing device according to claim 1, in which the shaped projection has in plan view a substantially semicircular or "filled U" outline and presents on its side surface a groove, at least in correspondence of each of the two legs of the said "U" outline.

3. A lacing device according to claim 2, in which the locking element is a U-shaped plate the legs of which are formed so as to present channel portions capable of slidably engaging the corresponding grooves provided on the shaped projection, thus defining a pair of tubular channels.

4. A lacing device according to claim 2, in which the groove on the side surface of the shaped projection runs along the legs and the base of the U-outline.

5. A lacing device according to claim 2, in which the locking element is a U-shaped plate formed so as to define a U-shaped channel and capable to slidably engage at least with its legs the groove provided on the side surface of the shaped projection.

6. A lacing device according to claim 1, in which the anchoring member consists of at least a toothed section on the locking element plate.

7. A lacing device according to claim 1, in which the anchoring member consists of at least a projecting lug formed on the locking element plate and presenting a suitable inclination with respect to the surface of the plate, said lug being capable of engaging a correspondingly inclined surface provided on the flap.

8. A lacing device according to claim 2, in which at least a second projection is provided on the flap, aligned with the first shaped projection on a line transversal to the opening defined by the flaps, said second projection being provided, at least on its side located farthest from the said opening, with a groove.

* * * * *